US005549329A

United States Patent [19]

Wuerslin et al.

[11] Patent Number: 5,549,329

[45] Date of Patent: Aug. 27, 1996

[54] SKI POLE AND REMOVABLE HAND GRIP

[75] Inventors: Peter C. Wuerslin, Jackson; Frederick E. Liu, Wilson, both of Wyo.; Andrew D. Maslow, New York, N.Y.

[73] Assignee: Life-Link International, Inc., Jackson, Wyo.

[21] Appl. No.: 375,391

[22] Filed: Jan. 18, 1995

[51] Int. Cl.[6] ..... A63C 11/22

[52] U.S. Cl. ..... 280/821

[58] Field of Search ..... 280/820, 821, 280/822; 135/25.4, 76; D8/DIG. 6; 16/14 R, DIG. 12, DIG. 19

[56] References Cited

U.S. PATENT DOCUMENTS

| | | | |
|---|---|---|---|
| 3,525,532 | 8/1970 | Baldsiefen | 280/820 |
| 3,556,544 | 1/1971 | Hauser | 280/821 |
| 3,561,782 | 2/1971 | Tyrack | 280/821 |
| 4,657,282 | 4/1987 | Koch | 280/821 |

FOREIGN PATENT DOCUMENTS

| | | | |
|---|---|---|---|
| 1502548 | 11/1967 | France | 280/821 |
| 1409303 | 7/1988 | U.S.S.R. | 280/821 |
| 8909637 | 10/1989 | WIPO | 280/820 |

*Primary Examiner*—Karin L. Tyson
*Attorney, Agent, or Firm*—Andrew D. Maslow

[57] ABSTRACT

An improved ski pole is provided containing an easily removable hand grip. The grip contains an inner sleeve, an outer covering over the inner sleeve and hand operational pressure means for tightening and loosening the inner sleeve on the shaft of the ski pole.

3 Claims, 8 Drawing Sheets

SKI POLE AND REMOVABLE HAND GRIP

BACKGROUND OF THE INVENTION

This invention relates to an adjustable length ski pole and, more particularly, to an easily removable grip for a ski pole which allows for a limited adjustment of the effective length of the ski pole. The invention provides a quick and easily removable grip which is especially useful in connection with ski poles designed to be quickly converted to an avalanche probe. The invention also provides an easily removable ski pole grip with an integrated hand guard.

In the prior art there are various types of adjustable length ski poles. Most of them utilize a telescoping tube system. For example, U.S. Pat. Nos. 4,596,405, 4,456,285, 4,448,422, 3,722,903, 3,712,652, 3,556,544, and 4,288,102 all utilize two telescopic tubular pole sections. All such ski poles have the disadvantage of having extra weight due to the overlapping of the two tubular sections when the pole is shortened.

The ski pole sold by Goode Ski Technologies and partially described in U.S. Pat. No. 5,024,866 uses a ski pole grip which provides a limited means for adjusting the effective length of the ski pole. In the Goode pole the grip is slidable relative to the ski pole shaft and is secured to the shaft by the tightening of a bolt or screw. The tightening or loosening of the ski pole grip requires the use of a tool and can not be done by a hand only operation. The need for such a tool is a significant disadvantage especially if the skier needs to remove the grip in an emergency situation or desires to adjust the grip when skiing and does not have the special tool readily available.

Backcountry skiers and ski patrolpeople like to have ski poles that can quickly be converted to an avalanche probe in an emergency. If a skier is caught and buried in an avalanche and is not quickly located, the skier may suffocate. Avalanche probes are used to poke into the snow to locate a buried skier. For many years ski poles which can be connected to each other have been available. U.S. Pat. No 4,288,102 to Ramer illustrates such an avalanche probe. These ski pole/probes have a male connection at the top of one pole shaft and a female connection at the top of the other pole shaft. When converting such poles to an avalanche probe first a basket is removed from one of the ski poles. Next, both of the ski pole grips are removed. The pole with the male end is connected to the pole with the female end. This effectively doubles the length of the pole. The probe is now ready for use. In order for this system to work quickly in an emergency, the ski pole grips must be easily removable. The prior art ski pole/avalanche probes have grips which do not contain fastening means for tightening and loosening the connection of the grip to the ski pole shaft. Some merely provide a fairly loose fitting grip on the end of the shaft. If the grip fits too loosely, it may slip off inadvertently during normal skiing. If the grip fits too snugly it may be difficult to remove in the emergency situation where it must be quickly converted to an avalanche probe.

Many of today's slalom ski racers require hand guards on their ski poles. Today's slalom courses comprise a series of single pole gates which are secured in the snow and which are provided with a hinge which allows the skier to knock down the pole and for the pole to upright itself after the skier passes the gate. The knocking down of these hinged gates is called clearing or blocking and is often done by the skier hitting the gate with a ski pole just below the ski pole grip. The force of the impact can be significant since it is dependant on the speed of the racer. Without a hand guard, on impact the blocked gate frequently runs up the pole and hits the racers hand, hence the need for a hand guard.

Modern ski racing hand guards are removable and are attached by fixing one end of the guard on the surface of the ski pole shaft and, in some instances the other end is attached to the top of the ski pole grip by a screw or bolt extending downward into the center of the shaft. The attachment to the ski pole can not require a hole to be made in the ski pole shaft since such a hole would significantly weaken the pole at that point. The only point where the hand guards can be screwed or bolted to the pole has been on the top of ski pole grip with the screw or bolt extending into the middle of the shaft and hence not requiring any hole to be made in the shaft. A significant problem with modern hand guards is that they are not directly attached to the ski pole shaft. This means that the hand guards tend to rotate relative to the ski pole grip after a hard impact leaving the outside of the hand exposed to the gates to be blocked. To solve this problem many racers tape the end of the handguard to the pole to avoid such annoying rotation during a slalom race.

There has been a recent trend toward using plastic composite materials for ski pole shafts in place of aluminum. The composite materials allow the diameter of the shafts to be significantly reduced. Because of the reduced diameter of the composite shafts, the surface area to which the hand grip fits is also reduced. This presents a problem in that hand grips typically are attached to the shafts by a tight fit and are held onto the shaft primarily by friction. With the reduced surface area of the composite shafts, the forces of friction are reduced. One solution to this problem is to use a set screw or bolt which is tightened once the grip is inserted onto the shaft. Once the set screw is tightened, in order to remove the grip, the set screw must be loosened first, and to do so, one must use some form of a tool. This presents a problem in an emergency avalanche situation where the ski pole needs to be converted to a probe as fast as possible and the tool needed to loosen the grip is not readily available.

SUMMARY OF THE INVENTION

In accordance with the invention an improved ski pole and removable ski pole grip are provided. The grip comprises an inner sleeve and an outer cover. The outer cover and inner sleeve may be made of the same or different materials. In the event that they are made of the same material, they may be fabricated together and will appear to be just a single unit.

The inner sleeve is provided with pressure means for tightening and loosening the sleeve relative to the shaft of the ski pole. The pressure means do not require any tools for its operation and are herein referred to as being hand only operational. Once tightened, the hand only operational pressure means exerts a frictional force on the shaft making it extremely difficult to remove the grip from the shaft. When the hand only operational pressure means is loosened, the inner sleeve exerts little to no pressure on the shaft and the inner sleeve and grip may be easily removed.

The invention also provides a ski pole with a thin diameter shaft such as those which are commonly made with a carbon fiber or other plastic composite materials. Because of the relatively small diameter of the shaft hand operational only pressure means are not as effective for tightening or loosening the grip to the shaft. For such thin shaft ski poles a collet is provided beneath the inner sleeve and surrounding a portion of the upper shaft. A compression ring is permanently fixed to the shaft about 2½ inches from the top of the shaft. The inner sleeve is slidable relative to the collet. The inner surface of the collet contains spaced groves that are sufficiently deep to accept the compression ring fixed to the shaft. Expansion means are provided on the collet which allow the inner surface of the collet to be loosened or tightened relative to the shaft. Since the collet is closed, the fixed ring is accepted in one of the groves on the inner surface of the collet. The inner sleeve is then slid down to cover the collet. The hand only operational pressure means is tightened to exert frictional pressure on the collet, which in turn exerts pressure on the thin diameter ski pole shaft thereby affixing the inner sleeve and the grip to the shaft.

The invention further provides a removable hand guard which is fixed directly to the inner sleeve so as to prevent rotation relative to the axis of the inner sleeve and hence to the grip.

Therefore it is an object of the invention to provide an improved ski pole and grip which allows the grip to be easily removed and attached.

A further object of the invention is to provide a ski pole grip which allows a limited adjustment of the effective length of the ski pole.

Yet another object of the invention is to provide an easily attachable and removable grip to a thin diameter ski pole shaft.

Still another object of the invention is to provide an improved thin shaft ski pole and a hand grip on the pole which allows for a limited adjustment of the effective length of the ski pole.

Another object of invention is to provide a removable ski pole grip which itself has a removable hand guard which may be fixed to the grip to prevent rotational movement relative to the axis of the grip.

Still another object of the invention is to provide an improved ski pole that is easily converted to an avalanche probe.

The invention accordingly comprises the features of construction, combination of elements and arrangement of parts which will be exemplified in the construction hereinafter set forth, the scope of the invention will be indicated in the claims.

BRIEF DESCRIPTION OF THE DRAWINGS

FIG. 1C also shows a perspective side view of the removable hand guard.

FIG. 3C is a top view of the grip without the hand guard.

DETAILED DESCRIPTION OF THE PREFERRED EMBODIMENT

Figure 1A:
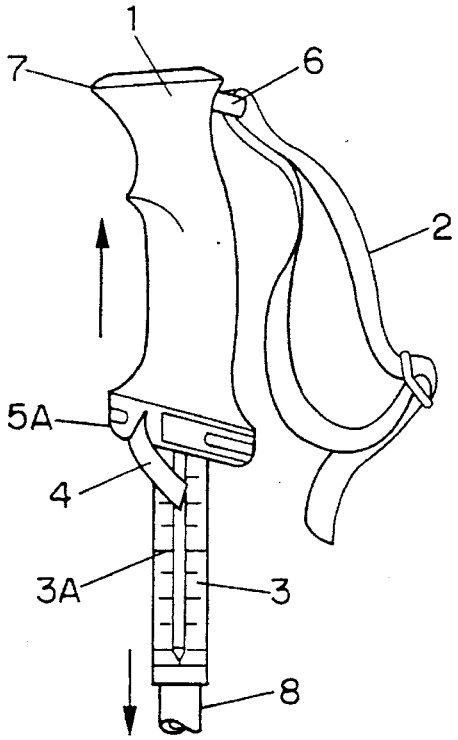
FIG. 1A is first side perspective of the grip and collet with the grip loosened and raised to the top of the collet.

In FIG. 1A the removable hand grip 1 is shown without the removable hand guard. Outer cover 7 is provided over an inner core 5 of FIG. 2A and 2B, the base of which is shown as 5A. Cam lever 4 is in an open position which allows the inner core base 5A to be in an expanded condition. Collet 3 is shown surrounding shaft 8. Collet 3 can be slid relative to shaft 8 either upward or downward as shown by the arrows in FIG. 1A. If the collet is moved in an upward direction the length of the ski pole shaft is effectively increased. Moving the collet downward effectively shortens the length of the extended shaft. In the most upward position the collet increases the effective length of the shaft an additional 2 inches.

Figure 1B:
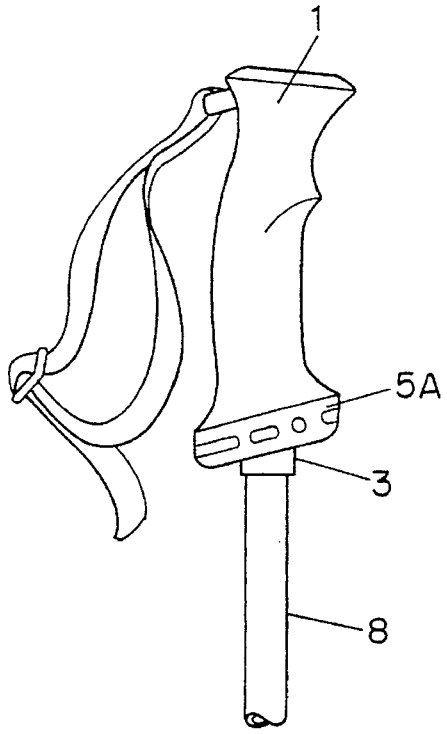
FIG. 1B is the other side perspective of the grip but with the grip lowered and tightened on the collet.
Figure 1C:
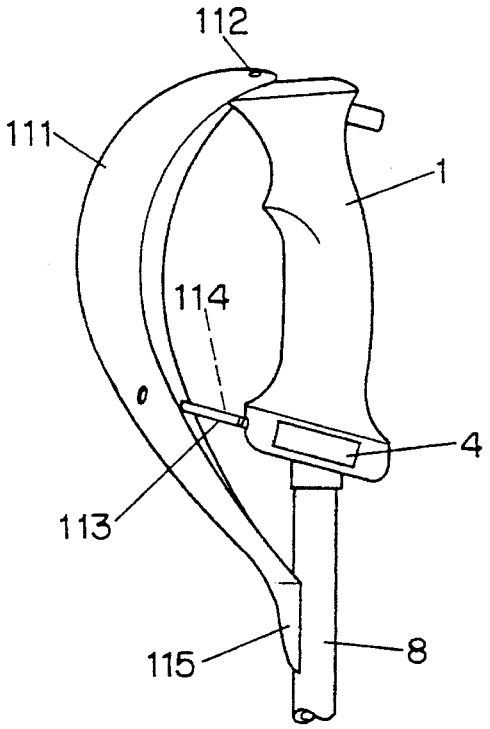
FIG. 1C is a side perspective with the grip in a tightened position and the grip lowered on the collet.

Once the collet is placed in position for the desired length, the loosened grip is lowered onto the collet so that it substantially covers the collet as show in FIGS. 1B and 1C. Cam lever 4 is then closed and the grip is firmly secured to the shaft.

Figure 7B:
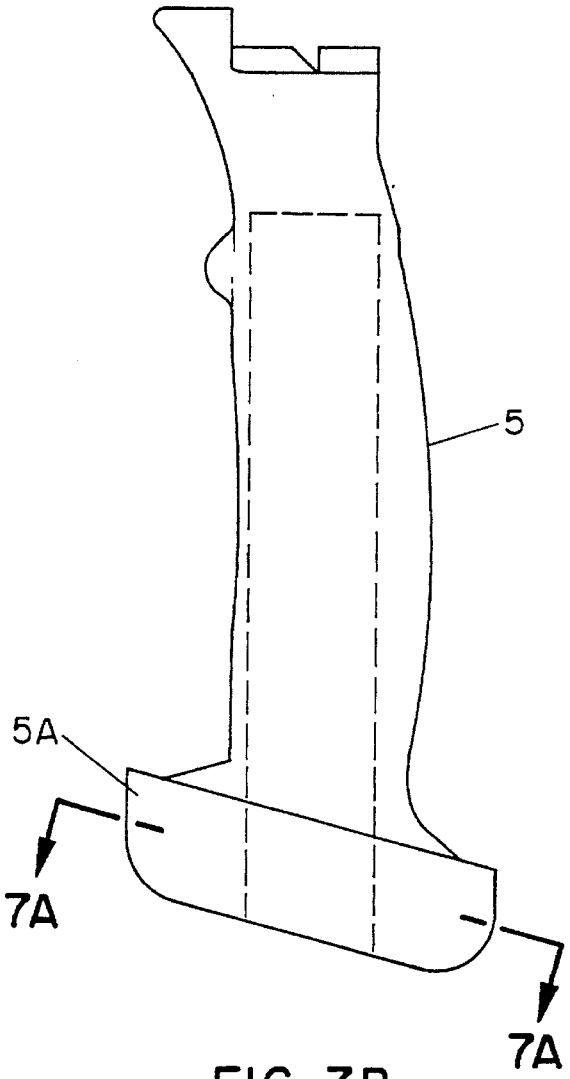
FIG. 7B is a cross section of the inner core (without the collet) and outer cover.
Figure 7A:
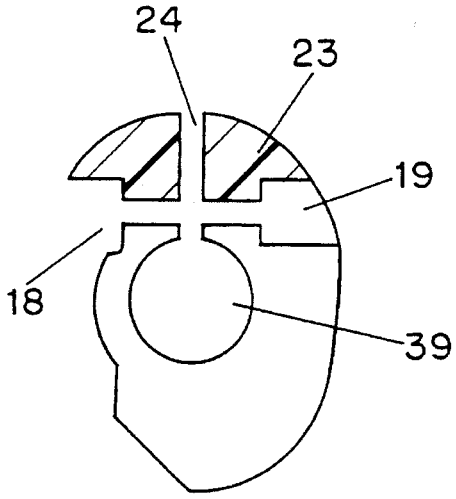
FIG. 7A is a cross section of the base of the inner core (without the collet) taken along line A—A of FIG. 7B.

Use of the collet is only necessary for composite ski pole shafts whose diameters are significantly reduced from the diameters of typical metal shafts. Typical metal shafts are 15–20 mm in diameter. Such shafts do not require the use of the collet and the diameter of the shaft is about 1 mm or less than the diameter of the opening 39 of the inner core into which the shaft is fit. In such case, when the cam lever 4 is in a closed position, the base 5A of the inner core decreases the diameter of the opening of the inner core by 1–2 mm. In the preferred embodiment the inner core must be sufficiently flexible to be able be moved by cam lever 4 so that the width of space 24 of FIG. 7A is decreased. The material must have sufficient memory to retain its original shape when the cam lever 4 is in an open position. Cam lever 4 can be operated by hand and is thus a hand only operational pressure means having an open and closed positions. When in the open position, it loosens inner sleeve 39 and when in a closed position tightens inner sleeve 39 relative to the shaft or collet 3. The inner core is preferably made from a high density, high impact thermoplastic such as polyphthalimide or nylon but can be can be made from most thermoplastic materials.

Due to the hardness of the inner core, screws 113 and 114 can be self taping and inserted into appropriate holes made in the base 5A of the inner core.

Figure 1D:
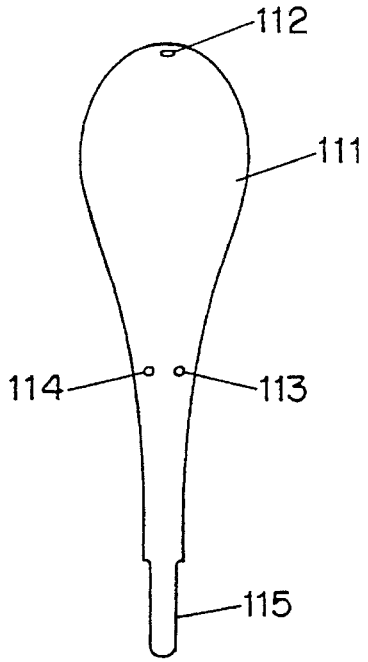
FIG. 1D is a front view of the removable hand guard.

The removable hand guard 111 is shown in FIGS. 1C and 1D. The hand guard is attached to the top of the grip by screw 112 which extends through the outer cover and into the inner core of the grip. Screws 113 and 114 secure the grip to the base 5A of the inner core. This firmly secures the hand guard to the grip so that even if pole shaft rotates relative to the grip, the hand guard continues to protect the hand and the hand guard is not fixed to the shaft. The end 115 of the hand guard is adapted to grip the shaft by friction but still is easily rotated about the shaft.

Figure 2A:
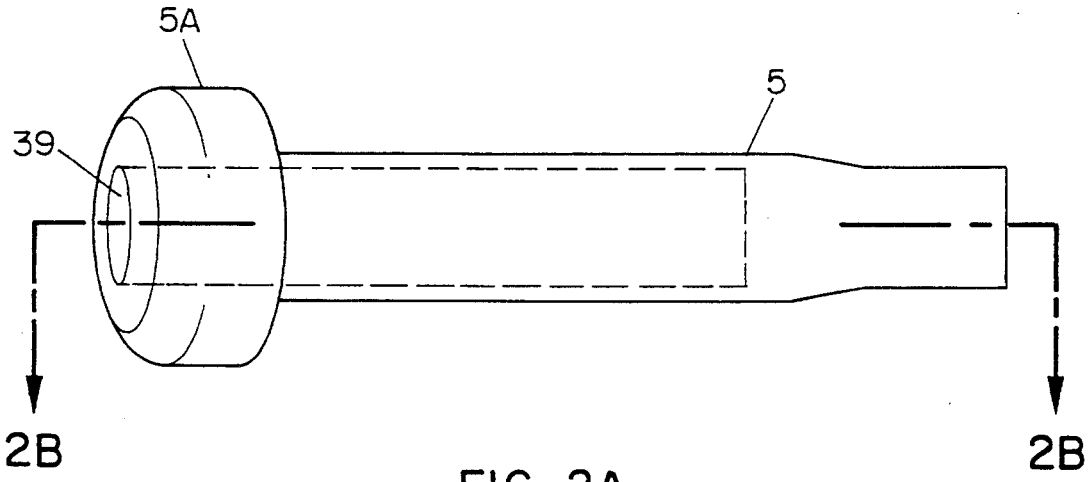
FIG. 2A is a side perspective of the inner core of the grip.
Figure 2B:
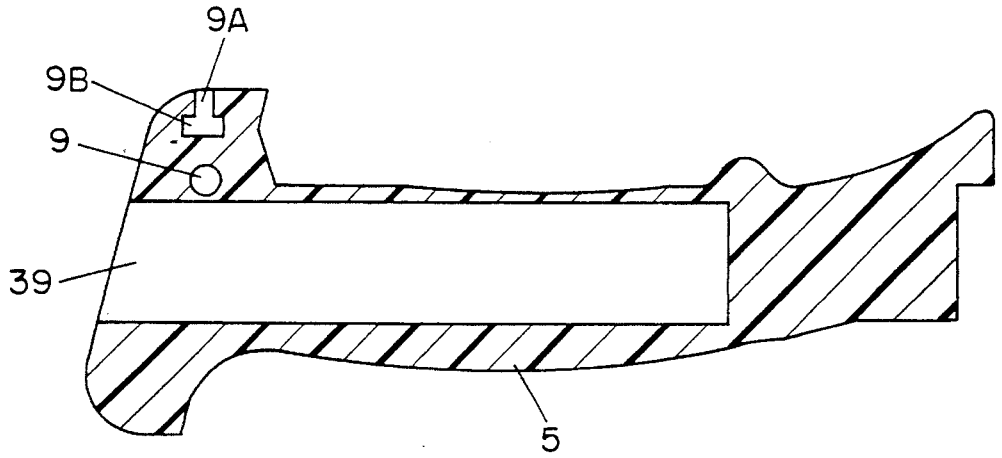
FIG. 2B is a cross section of the inner core taken along line 2B—2B of FIG. 2A.

In FIGS. 2A and 2B the inner core 5 is shown with shaft hole 39 which can accommodate collet 3 or a 15–20 mm full width metal shaft. Inner core base 5A is shown with hole 9 which is used to accept cam bolt 17 shown in FIG. 6. Recess 9A can be used to accept hand guard screw 113. An additional recess (not shown) but similar to 9A is used to accept hand guard screw 114. Recess 9B may be used to accept a nut if hand guard screws 113 and 114 are replaced by a bolt.

Figure 3A:
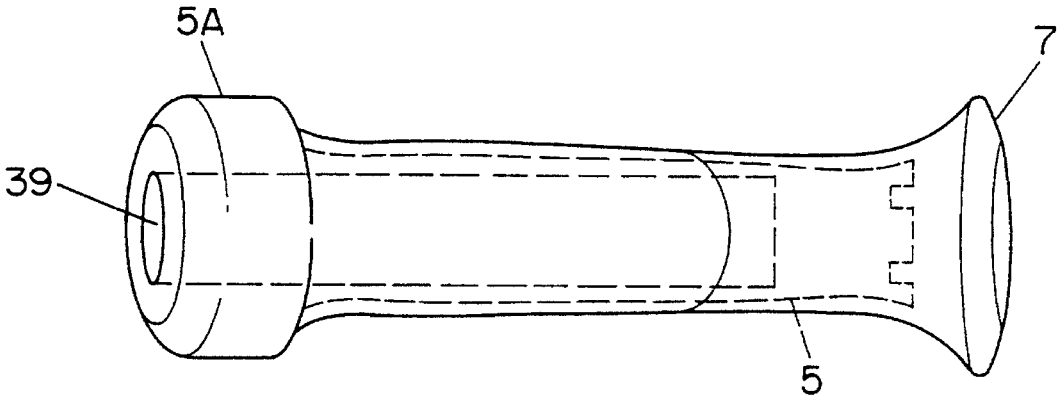
FIG. 3A is an upper perspective of the outer cover for the inner core of the grip.
Figure 3B:
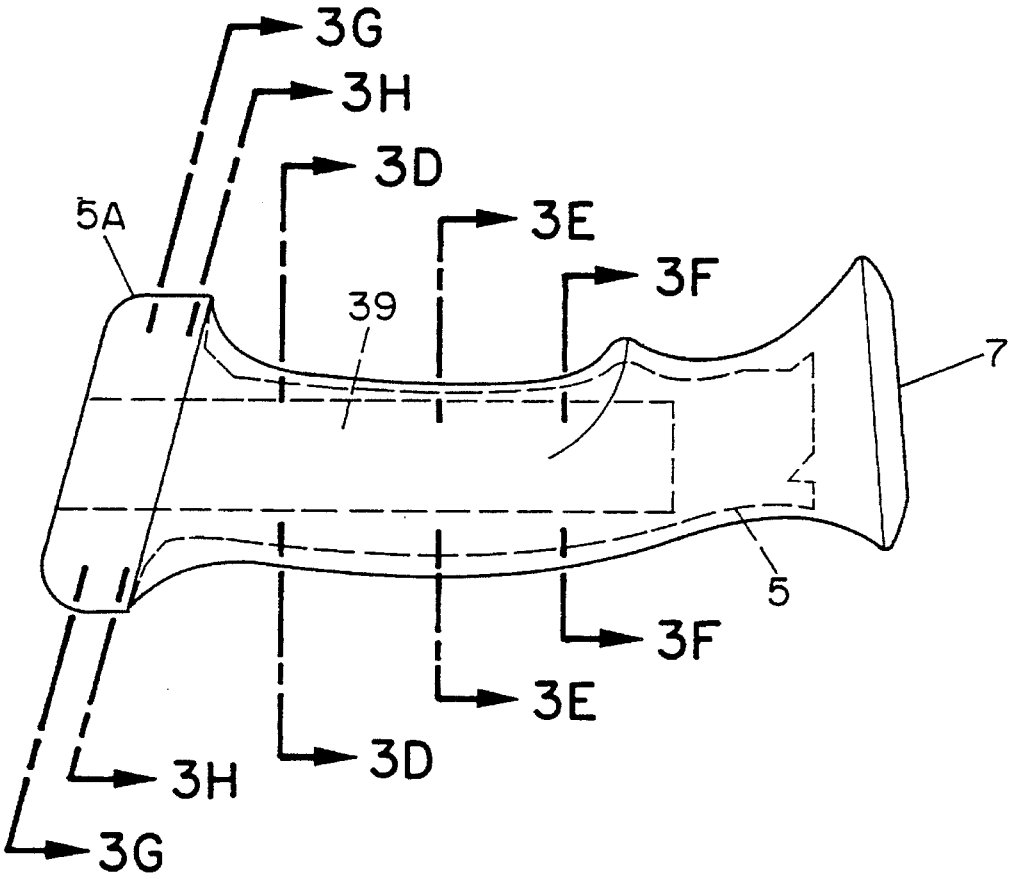
FIG. 3B is a side perspective of the outer cover for the inner core of the grip and FIGS. 3C, 3D, 3E, 3F, 3G and 3H are cross sections of 3B taken along lines 3C—3C, 3D—3D, 3E—3E, 3F—3F, 3G—3G and 3H—3H.
Figure 3C:
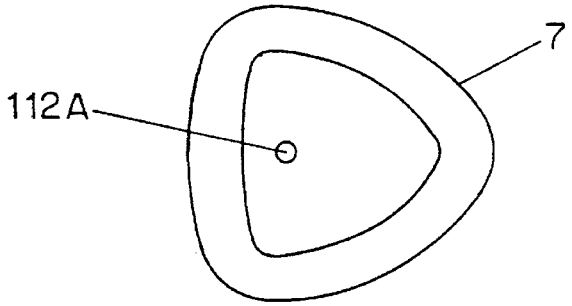
Figure 3D:
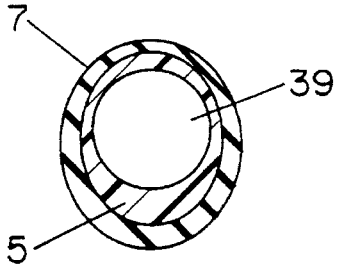
Figure 3E:
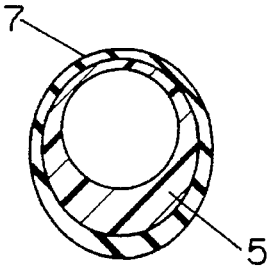
Figure 3F:
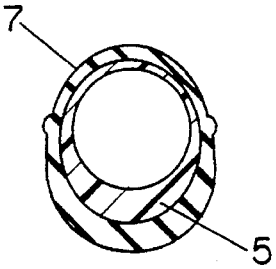
Figure 3G:
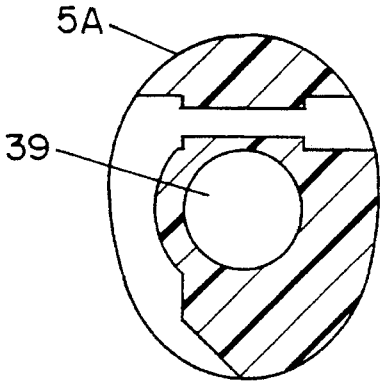
Figure 3H:
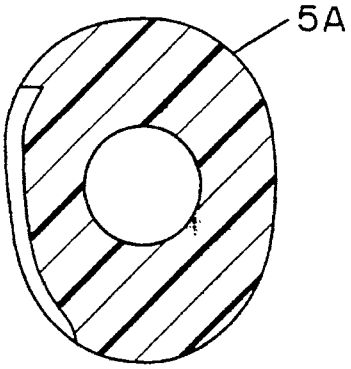

In FIG. 3A the outer cover 7 is shown which can be made from any suitable plastic or rubber. In FIG. 3B a side perspective view is shown of the outer cover and FIGS. 3C, 3D, 3F, 3G and 3H show various cross sections of the outer cover of FIG. 3B. It can be seen that the inner core forms a inner sleeve or shaft hole 39 which is roughly equal in diameter to that of the ski pole shaft to be used.

Figure 4A:
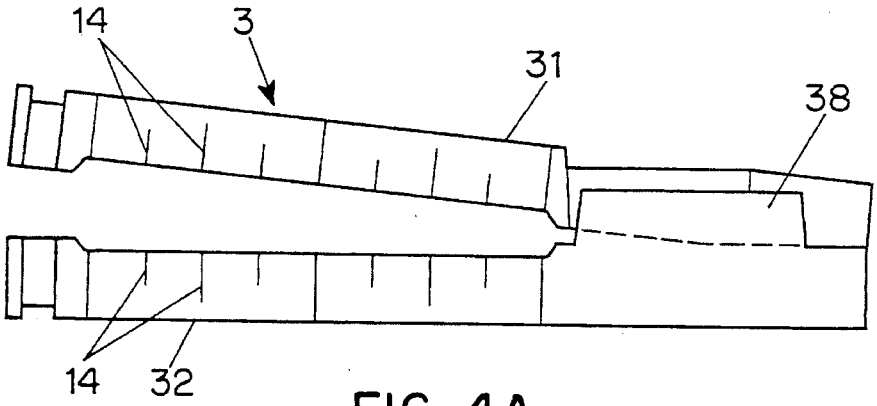
FIG. 4A is a side view of the collet in an open position.
Figure 4B:
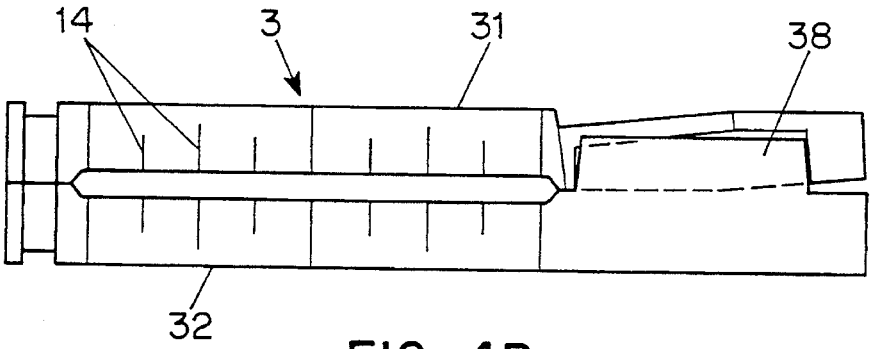
FIG. 4B is a side view of the collet in a closed position and FIG. 4C is a partial side view of the collet in a closed position.
Figure 4C:
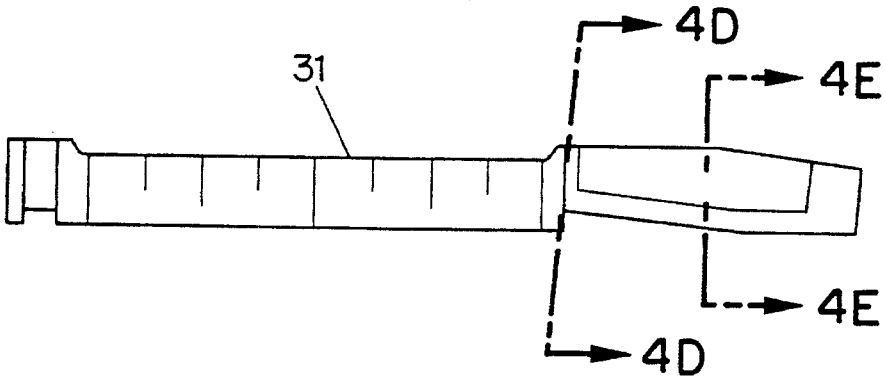
Figure 4D:
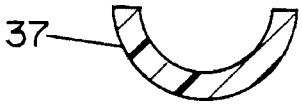
FIGS. 4D and 4E are cross sections of FIG. 4C taken along lines 4D—4D and 4E—4E.
Figure 4E:
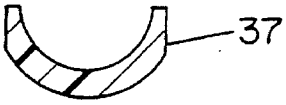
Figure 4F:
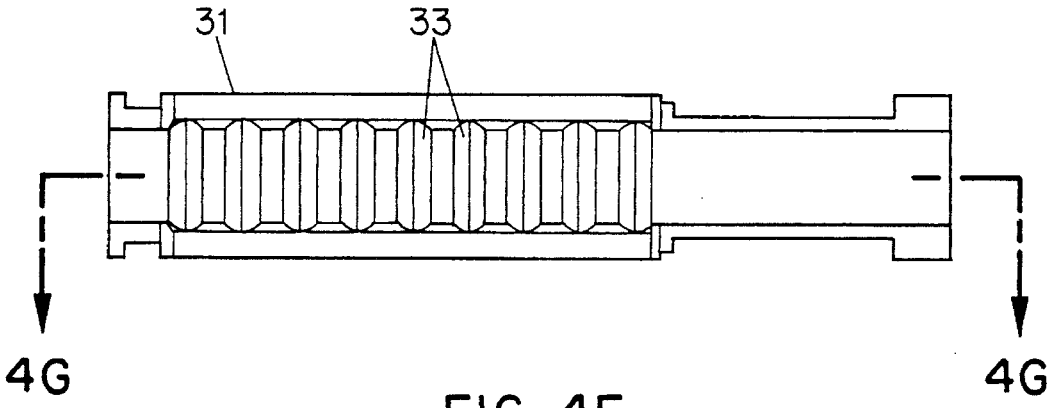
FIG. 4F is a partial side view of the collet in a closed position on the shaft of the ski pole.
Figure 4G:
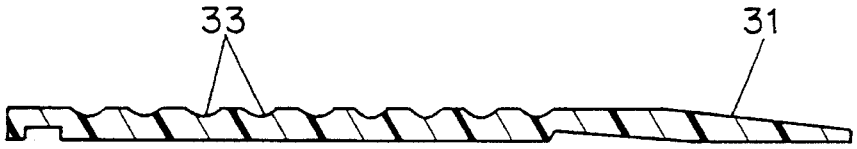
Figure 5A:
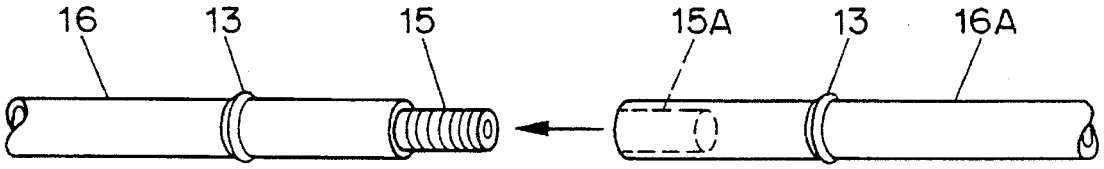
FIG. 5A is a side view of the male and female shafts showing how they may be attached to covert them into a probe before they are attached and FIG. 5B shows the shafts being attached.

In FIG. 4A the collet 3 is shown in an open or expanded position and in FIG. 4B is shown in a closed position. In FIGS. 4D and 4E views are shown of the female or lower half 32 of collet 3. Collet 3 has an upper half 3T (male) and a lower half (female) 32. Ridge 38 on the lower half 32 of collet 3 accommodates upper half 31. By reason of the collet being divided into two halves 31 and 32, when the halves are slightly separated they effectively amount to expansion means allowing the collet to be opened and closed relative to the shaft. The collet is separate from the grip and fits inside shaft hole 39 of the inner core. Adjustment grooves 14 are inscribed on both the upper and lower halves of the collet. A compression ring 13 is fixed near the end of the composite shaft as shown in FIG. 5A to form a permanent ridge. The collet is moved up or down the shaft so that the fixed compression ring or ridge fits into one of the adjustment grooves. In FIG. 4B nine different positions of the adjustment grooves are shown, each being capable of accommodating the fixed compression ring 13 on shaft 8. It can also be appreciated that in place of the fixed compression ring a permanent groove may be made on the shaft. In such case the collet would have a series of ridges instead of grooves.

Figure 6:
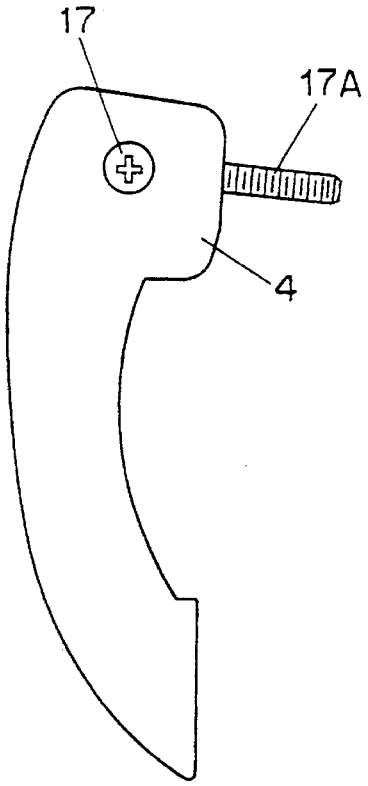
FIG. 6 is a top view of the cam lever and holding bolt.
Figure 7C:
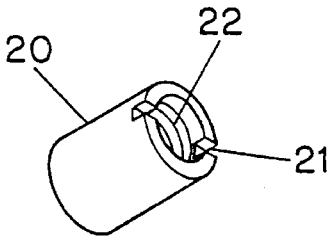
FIG. 7C is perspective view of the holding nut for holding bolt for the cam lever.

In FIG. 6 cam lever 4 is shown with cam bolt 17 inserted within. In FIG. 7A, a cross section of inner core base 5A, recess 18 accommodates cam lever 4. Recess 23 accommodates cam lever bolt 17 and recess 19 accommodates the cam lever adjustment nut shown in FIG. 7C. It can be seen that thread 17A on cam lever 17 fits the thread grooves 22 on cam lever adjustment nut 20. The tightening of the cam lever adjustment nut closes recess 24 of inner base core 5A effectively reducing the diameter of the shaft hole 39 formed by the opening of the inner core in the vicinity of the base 5A. Slot 21 is provided so that the cam lever adjustment nut can be tightened with a screw driver. Once the cam lever adjustment nut is set, opening of the cam lever 4 loosens the pressure on inner core base 5A and expands recess 24 thereby enlarging the diameter of shaft hole 3A. Thus in the open position the entire grip is easily removed from shaft 8.

Figure 5B:
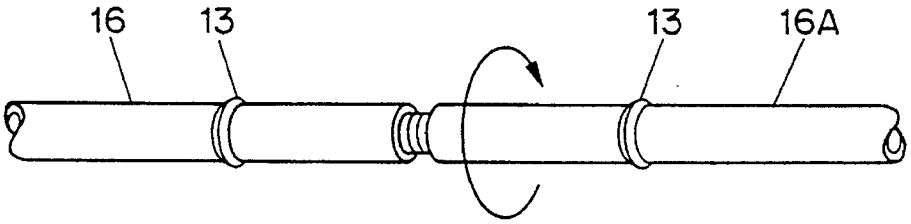
Figure 8:
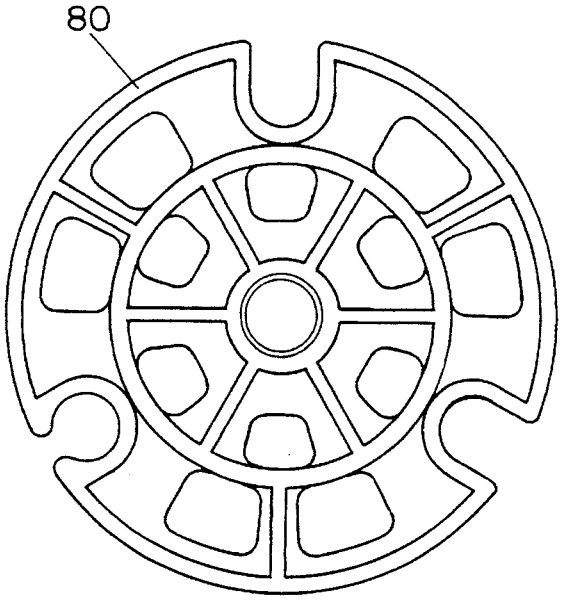
FIG. 8 is a top view of the removable basket.
Figure 9:
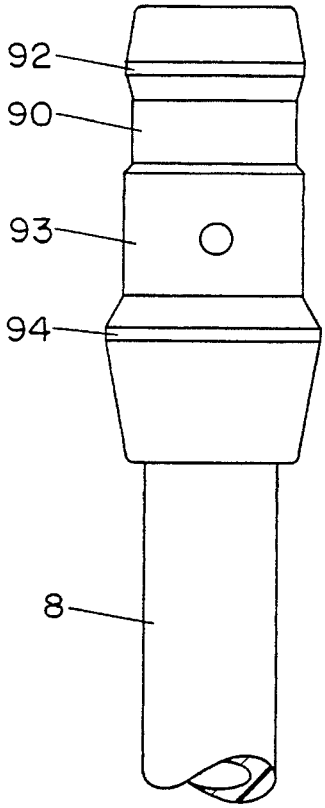
FIG. 9 is a side view of the ferrule that is used to hold the basket in place.
Figure 8A:
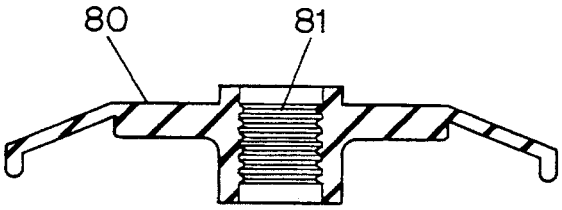
FIG. 8A is a side view of the removable basket.

Since the hand grip is easily removable, the ski pole can quickly be converted to an avalanche probe once the grips and one of the baskets are removed. In FIG. 5 male pole shaft 16 is provided with a male fitting 15 with threads adapted to fit into the thread grooves of female fitting 15A of female pole shaft 16A. The shafts are then connected by a simple turning motion shown in the lower part of FIG. 5. The removable ski pole basket such a basket 80 of FIG. 8, which is located at the opposite end of the ski pole from the hand grip and is located between ridges 94 and 92 of the ferrule shown in FIG. 9, is then removed by placing the basket between the two soles of ski boots and pulling upward on the shaft. The grooved fitting 81 of FIG. 8A is adapted to fit snugly over ferrule 90 of FIG. 9 and is forced over ridges 92 and 93. Ridge 94 prevents the basket from moving further up the ski pole shaft 8. The ferrule 19 is at the tip end of the ski pole and at the other end of shaft 8 the removable hand grip is located.

It will thus be seen that the objects set forth above, among those made apparent from the preceding description, are efficiently attained and, since certain changes may be made in carrying out the above ski pole and ski pole grip without departing from the spirit and scope of the invention, it is intended that all matter contained in the above description and shown in the accompanying drawings shall be interpreted as illustrative and not is a limiting sense.

It is also to be understood that the following claims are intended to cover all of the generic and specific features of the invention which as a matter of language might be said to fall therebetween.

What is claimed is:

1. An improved ski pole comprising:

a shaft having an upper and lower portion;

a collet surrounding part of the upper portion of the shaft and having an inner surface which maintains contact with the shaft;

a permanent ridge or groove on said upper portion of the shaft;

said collet comprising one or more grooves or ridges on the inner surface of the collet, which grooves or ridges are adapted to accept the permanent ridge or groove on the shaft; expansion means on the collet to allow the collet to be opened and closed relative to the shaft;

an inner sleeve surrounding the collet;

an outer cover secured to said inner sleeve;

a hand only operational pressure means having at least two positions, one for tightening and one for loosening said inner sleeve relative to the collet and the shaft of a ski pole so that when the collet is closed on said shaft with the ridge or grove on said upper portion of the shaft being accepted in the corresponding grove of said collet and the hand only operational pressure means is in a tightened position, movement of the shaft relative to the combination of the collet, inner sleeve and outer cover is inhibited.

2. The improved ski pole grip of claim 1 further comprising removable hand guard means fixed directly to the inner sleeve so that rotational movement relative to the axis of the inner sleeve is prevented.

3. The improved ski poles of claim 1 further comprising means to attach the shaft of one ski pole to an other in order to form one avalanche probe.

* * * * *